US008789594B2

(12) United States Patent
Curole et al.

(10) Patent No.: US 8,789,594 B2
(45) **Date of Patent: *Jul. 29, 2014**

(54) WATER INJECTION SYSTEMS AND METHODS

(75) Inventors: Michael Alvin Curole, Baton Rouge, LA (US); Eugene Bruce Greene, Sheridan, WY (US)

(73) Assignee: Shell Oil Company, Houston, TX (US)

( * ) Notice: Subject to any disclaimer, the term of this patent is extended or adjusted under 35 U.S.C. 154(b) by 1186 days.

This patent is subject to a terminal disclaimer.

(21) Appl. No.: 12/295,183

(22) PCT Filed: Mar. 22, 2007

(86) PCT No.: PCT/US2007/064608

§ 371 (c)(1), (2), (4) Date: Mar. 26, 2009

(87) PCT Pub. No.: WO2007/112254

PCT Pub. Date: Oct. 4, 2007

(65) Prior Publication Data

US 2009/0308609 A1 Dec. 17, 2009

Related U.S. Application Data

(60) Provisional application No. 60/786,274, filed on Mar. 27, 2006.

(51) Int. Cl.

| | |
|---|---|
| ***E21B 43/16*** | (2006.01) |
| ***E21B 43/24*** | (2006.01) |
| ***E21B 43/20*** | (2006.01) |

(52) U.S. Cl.

CPC ..... *E21B 43/20* (2013.01)
USPC ..... 166/272.3; 166/268

(58) Field of Classification Search

None

See application file for complete search history.

(56) References Cited

U.S. PATENT DOCUMENTS

| | | | | |
|---|---|---|---|---|
| 4,204,574 | A | 5/1980 | Stalder | 166/305 R |
| 4,341,629 | A | 7/1982 | Uhlinger | 210/128 |
| 4,401,789 | A * | 8/1983 | Gideon | 524/827 |
| 4,409,110 | A | 10/1983 | Borchardt et al. | 252/8.55 D |
| 4,448,697 | A * | 5/1984 | McCoy et al. | 507/225 |
| 4,580,627 | A | 4/1986 | Argabright et al. | 166/79 |
| 4,589,487 | A * | 5/1986 | Venkatesan et al. | 166/261 |
| 4,607,689 | A | 8/1986 | Mochida et al. | 165/110 |
| 4,675,348 | A | 6/1987 | Martischius et al. | 523/323 |
| 4,723,603 | A | 2/1988 | Plummer | 166/275 |
| 4,842,736 | A | 6/1989 | Bray et al. | 210/321.61 |

(Continued)

FOREIGN PATENT DOCUMENTS

| | | | |
|---|---|---|---|
| WO | WO 0212675 | 2/2002 | E21B 43/20 |

OTHER PUBLICATIONS

"Injection-Water Salinity, Formation Pretreatment, and Well-Operations Fluid-Selection Guidelines" Ronald F. Scheuerman and Barbara M. Bergersen, Journal of Petroleum Technology, vol./Issue: 42:7; Jul. 1990.

*Primary Examiner* — Angela M DiTrani

(57) ABSTRACT

A system comprising a well drilled into an underground formation; a production facility at the topside of the well; and a water production facility connected to the production facility; wherein the water production facility produces water by removing some ions and adding an agent which increases the viscosity of the water and/or increases a hydrocarbon recovery from the formation, and injects water into the well.

30 Claims, 4 Drawing Sheets

(56) References Cited

U.S. PATENT DOCUMENTS

| | | | | |
|---|---|---|---|---|
| 5,139,087 | A | 8/1992 | Hutchins et al. | 166/249 |
| 5,238,574 | A | 8/1993 | Kawashima et al. | 210/652 |
| 5,856,381 | A | 1/1999 | Rehmer et al. | 523/334 |
| 6,030,928 | A | 2/2000 | Stahl et al. | 507/121 |
| 6,190,556 | B1 | 2/2001 | Uhlinger | 210/636 |
| 6,196,314 | B1 * | 3/2001 | Chen | 166/275 |
| 6,783,682 | B1 | 8/2004 | Awerbuch | 210/652 |
| 7,455,109 | B2 * | 11/2008 | Collins | 166/275 |
| 2005/0107503 | A1 * | 5/2005 | Couillet et al. | 524/249 |
| 2007/0102359 | A1 * | 5/2007 | Lombardi et al. | 210/639 |

* cited by examiner

Figure 1 - Prior Art

WATER INJECTION SYSTEMS AND METHODS

PRIORITY CLAIM

The present application claims priority of U.S. Provisional Patent Application No. 60/786,274 filed 27 Mar. 2006.

FIELD OF INVENTION

The present disclosure relates to systems and methods for injecting water into a hydrocarbon bearing formation.

BACKGROUND

Oil accumulated within a subterranean oil-bearing formation is recovered or produced therefrom through wells, called production wells, drilled into the subterranean formation. A large amount of such oil may be left in the subterranean formations if produced only by primary depletion, i.e., where only formation energy is used to recover the oil. Where the initial formation energy is inadequate or has become depleted, supplemental operations, often referred to as secondary, tertiary, enhanced or post-primary recovery operations, may be employed. In some of these operations, a fluid is injected into the formation by pumping it through one or more injection wells drilled into the formation, oil is displaced within and is moved through the formation, and is produced from one or more production wells drilled into the formation. In a particular recovery operation of this sort, seawater, field water or field brine may be employed as the injection fluid and the operation is referred to as a waterflood. The injection water may be referred to as flooding liquid or flooding water as distinguished from the in situ formation, or connate water. Fluids injected later can be referred to as driving fluids. Although water is the most common, injection and drive fluids can include gaseous fluids such as air, steam, carbon dioxide, and the like.

Although conventional waterflooding is effective in obtaining additional oil from some oil-bearing subterranean formations. In other formations, water may have the tendency to "finger" through an oil-bearing formation and to thus bypass substantial portions thereof. By fingering is meant the development of unstable water stream fronts which advance toward the production wells more rapidly than the remainder of the flooding water. Furthermore, when fingering is encountered, the water does not normally displace as much oil in the portions of the formations which it contacts as it is potentially capable of displacing.

Also, waterfloods may be less effective with the more viscous oils than with relatively nonviscous oils. The fingering and bypassing tendencies of water may be related to the ratio of the viscosity of the oil to the viscosity of the flooding water, and also related to fractures and/or high permeability zones in the formation. The viscosity of these oils varies from as low as about one or two centipoise to about 1,000 centipoise or higher. Water generally has a viscosity of about 1 centipoise at room temperature.

In order to restrict the mobility of the flooding water to no greater than the mobility of the oil, water thickening agents have been added to increase the viscosity of the water.

There are two principal mechanisms of enhancing the oil recovery of an injected fluid. These methods include increasing volumetric sweep efficiency of the injected fluid and increasing the oil displacement efficiency by the injected fluid. Both techniques may involve the addition of agents which modify the properties of the injected fluid.

Water may be injected by itself, or as a component of miscible or immiscible displacement fluids. Sea water (for offshore wells) and brine produced from the same or nearby formations (for onshore wells) may be most commonly used as the water source.

Some injection drive fluids include water and a small amount of a water-soluble polymer, such as a polyacrylamide.

Referring to FIG. 1, there is illustrated prior art system 100. System 100 includes body of water 102, underground formation 104, underground formation 106, and underground formation 108. Production facility 110 may be provided at the surface of body of water 102. Well 112 traverses body of water 102 and formation 104, and has openings in formation 106. A portion of formation 106 may be fractured and/or perforated as shown at 114. Oil and gas may be produced from formation 106 through well 112, to production facility 110. Gas and liquid may be separated from each other, gas may be stored in gas storage 116 and liquid may be stored in liquid storage 118.

There is a need in the art for improved systems and methods for producing oil and/or gas from a subterranean formation. In particular, there is a need in the art for systems and methods for providing an improved polymer flood, which achieves a desired viscosity of a flooding fluid.

SUMMARY OF THE INVENTION

One aspect of the invention provides a method comprising removing some ions from water; adding an agent to the water, which increases the viscosity of the water and/or increases a hydrocarbon recovery from an underground formation, for example a surfactant and/or an alkali; and injecting the water with the agent into the underground formation.

One aspect of the invention provides a system comprising a well drilled into an underground formation; a production facility at a topside of the well; a water production facility connected to the production facility; wherein the water production facility produces water by removing some ions and adding an agent which increases the viscosity of the water and/or increases a hydrocarbon recovery from the formation, and injects the water into the well.

Another aspect of the invention provides a system comprising a first well drilled into an underground formation; a production facility at a topside of a first well; a water production facility connected to the production facility; a second well drilled into the underground formation; wherein the water production facility produces water by removing some ions and adding an agent which increases the viscosity of the water and/or increases a hydrocarbon recovery from the formation, and injects the water into the second well and into the underground formation.

DETAILED DESCRIPTION OF THE INVENTION

Figure 1:
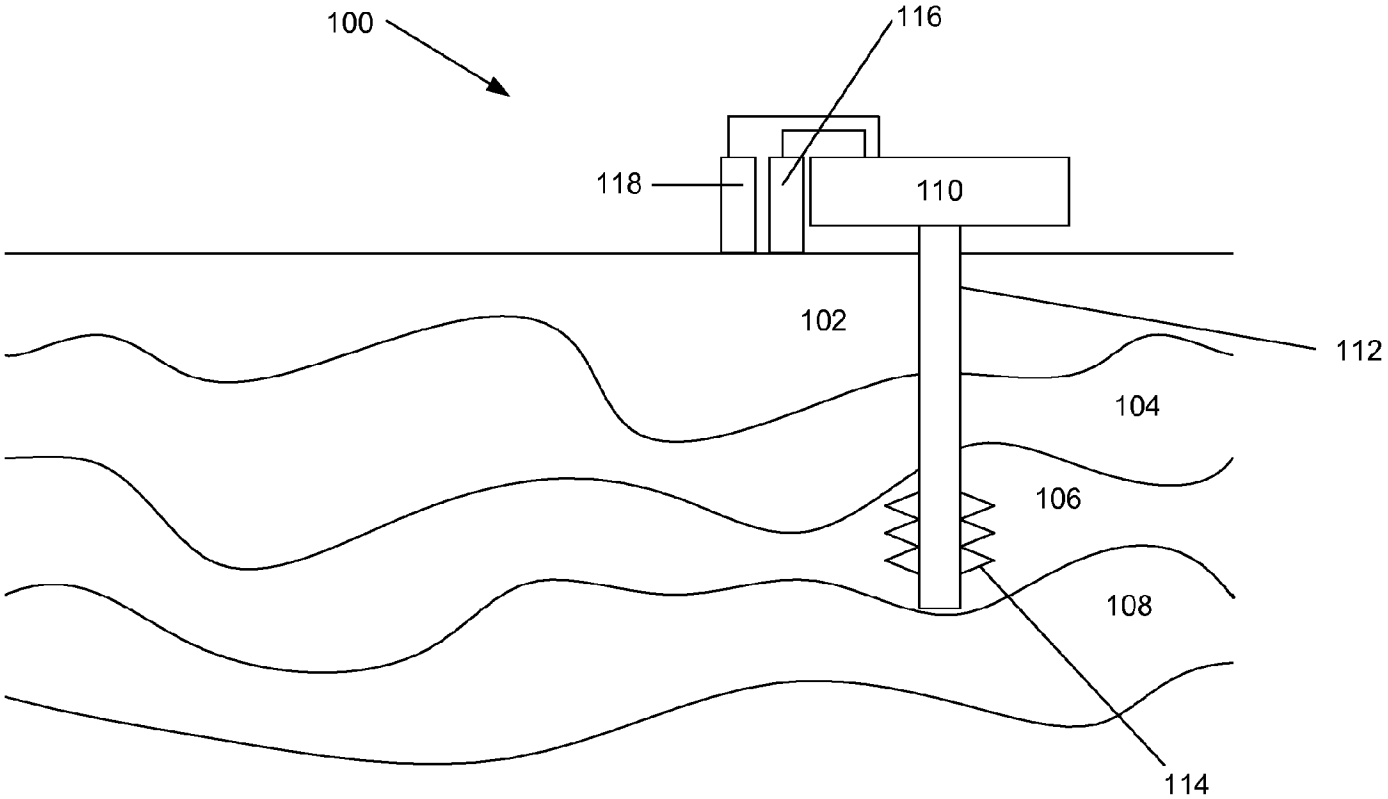
FIG. 1 illustrates a prior art oil and gas production system.

In one embodiment, there is disclosed a system comprising a well drilled into an underground formation; a production facility at a topside of the well; a water production facility connected to the production facility; wherein the water production facility produces water by removing some ions and adding an agent which increases the viscosity of the water and/or increases an oil recovery from the formation, and injects the water into the well. In another embodiment, there is disclosed a system comprising a first well drilled into an underground formation; a production facility at a topside of a first well; a water production facility connected to the production facility; a second well drilled into the underground formation; wherein the water production facility produces water by removing some ions and adding an agent which increases the viscosity of the water and/or increases an oil recovery from the formation, and injects the water into the second well and into the underground formation. In some embodiments, the first well is a distance of 50 meters to 2000 meters from the second well. In some embodiments, the underground formation is beneath a body of water. In some embodiments, the production facility is floating on a body of water, such as a production platform. In some embodiments, the system also includes a water supply and a water pumping apparatus, adapted to pump water to the water production facility. In some embodiments, the water production facility has an input water having a total dissolved salts value of at least 15,000 parts per million, expressed as sodium chloride dissolved. In some embodiments, the agent comprises one or more materials selected from the group consisting of: alkyl xylene sulfonates; alkyl benzene sulfonates; C18 alkyl toluene sulfonates; alkyl aryl sulfonates; alkyl naphthalene sulfonates; polyethoxyalkylated alkyl sulfate; Sodium lauryl ethoxy sulfate; Ethoxylated styrylaryloxy sulfonate; Polyoxyethylene alkylether sulfonate; Carboxymethylated ethoxylate; Nonylphenol polyethyleneoxide ether sulfate; Petroleum Sulfonates; Alkoxylated alkylphenol sulfonates; Alpha-olefin sulfonate C12-16; Alpha-olefin sulfonate C14-16; Alpha-olefin sulfonate C16-18; Internal olefin sulfonate C15-18; Internal olefin sulfonate C17-20; Sodium alkyl sulfate; Sodium methyl 2-sulfonyllaurate; Sodium lignosulfonate; Alkyl propoxy sulfates; Hydrolyzed Polyacrylamide; polyvinylpyrrolidones; hydroxyethyl celluloses; cellulose sulphate esters; guar gums; xanthans; scleroglucans; polyacrylic acid polymers; alkyl acrylamide polymers; polysaccharide polymers; copolymers of acrylamides and acrylic acid or sodium acrylate; N-sulfohydrocarbon-substituted acrylamides; biopolysaccharides; copolymers of acrylamide and sodium acrylate; solutions of partially saponified polyacrylamide; copolymers containing from 99 to 50 percent by weight acrylamide units and from 1 to 50 percent by weight acrylate units; polyacrylamide containing up to 10 mole percent carboxylate groups; random copolymers of 90 mole percent or more acrylamide and ten mole percent or less acrylic acid or acrylic acid salts; homopolymers of N-methylacrylamide or N,N-dimethylacrylamide; copolymers or terpolymers of 0.1-99.9 mole percent acrylamide and 99.9-0.1 mole percent N-methylacrylamide and/or N,N-dimethylacrylamide; poly(methylmethacrylate), poly(ethylmethacrylate), poly(methacrylamide), poly(methylacrylate), poly(ethylacrylate), poly(N-methylmethacrylamide) and/or poly(N,N-dimethylacrylamide); quaternary polymers with nitrogen or phosphorous as the quaternary or cationic atom with an aliphatic, cycloaliphatic or aromatic chain, where trivalent or tertiary sulfur may be substituted for the quaternary nitrogen or phosphorous in the polymers; and/or a polar and generally soluble polymer in polar solvents. In some embodiments, at least one well has been fractured with a viscous liquid and a propping agent such as sand. In some embodiments, at least one well comprises a diameter from 10 to 25 cm.

In one embodiment, there is disclosed a method comprising removing some ions from water; adding an agent to the water which increases the viscosity of the water and/or increases oil recovery from an underground formation; and injecting the water with the agent into the underground formation. In some embodiments, the processed water is recycled by being produced with oil and/or gas and separated, and then re-injected into the formation. In some embodiments, one or more of aromatics, chlorinated hydrocarbons, other hydrocarbons, water, carbon dioxide, carbon monoxide, or mixtures thereof are mixed with the processed water prior to being injected into the formation. In some embodiments, the processed water is heated prior to being injected into the formation. In some embodiments, the processed water is heated while within the formation. In some embodiments, the processed water is heated with hot water, steam and/or a non-aqueous liquid and/or gas injected into the formation. In some embodiments, removing some cations from water comprises removing some divalent cations. In some embodiments, removing some cations from water comprises removing some divalent cations and then removing some monovalent cations. In some embodiments, removing some cations from water comprises removing some divalent cations and then removing some monovalent cations, and then adding back some divalent cations. In some embodiments, another material is injected into the formation after the processed water was injected. In some embodiments, the another material is selected from the group consisting of air, produced water, salt water, sea water, fresh water, steam, carbon dioxide, and/or mixtures thereof. In some embodiments, the processed water is injected from 10 to 100 bars above the reservoir pressure. In some embodiments, the oil in the underground formation prior to water being injected has a viscosity from 5 cp to 10,000 cp. In some embodiments, the oil in the underground formation prior to water being injected has a viscosity from 500 cp to 5,000 cp. In some embodiments, the underground formation has a permeability from 5 to 0.0001 Darcy. In some embodiments, the underground formation has a permeability from 1 to 0.001 Darcy. In some embodiments, producing and/or injecting are done into a vertical and/or a horizontal well. In some embodiments, input water has a total dissolved salts value of at least 15,000 parts per million, expressed as sodium chloride dissolved, prior to the removing some cations from the water. In some embodiments, the agent comprises one or more materials selected from the group consisting of: alkyl xylene sulfonates; alkyl benzene sulfonates; C18 alkyl toluene sulfonates; alkyl aryl sulfonates; alkyl naphthalene sulfonates; polyethoxyalkylated alkyl sulfate; Sodium lauryl ethoxy sulfate; Ethoxylated styrylaryloxy sulfonate; Polyoxyethylene alkylether sulfonate; Carboxymethylated ethoxylate; Nonylphenol polyethyleneoxide ether sulfate; Petroleum Sulfonates; Alkoxylated alkylphenol sulfonates; Alpha-olefin sulfonate C12-16; Alpha-olefin sulfonate C14-16; Alpha-olefin sulfonate C16-18; Internal olefin sulfonate C15-18; Internal olefin sulfonate C17-20; Sodium alkyl sulfate; Sodium methyl 2-sulfonyllaurate; Sodium lignosulfonate; Alkyl propoxy sulfates; Hydrolyzed Polyacrylamide; polyvinylpyrrolidones; hydroxyethyl celluloses; cellulose sulphate esters; guar gums; xanthans; scleroglucans; polyacrylic acid polymers; alkyl acrylamide polymers; polysaccharide polymers; copolymers of acrylamides and acrylic acid or sodium acrylate; N-sulfohydrocarbon-substituted acrylamides; biopolysaccharides; copolymers of acrylamide and sodium acrylate; solutions of partially saponified polyacrylamide; copolymers containing from 99 to 50 percent by weight acrylamide units and from 1 to 50 percent by weight acrylate units; polyacrylamide containing up to 10 mole percent carboxylate groups; random copolymers of 90 mole percent or more acrylamide and ten mole percent or less acrylic acid or acrylic acid salts;

homopolymers of N-methyl-acrylamide or N,N-dimethylacrylamide; copolymers or terpolymers of 0.1-99.9 mole percent acrylamide and 99.9-0.1 mole percent N-methylacrylamide and/or N,N-dimethylacrylamide; poly(methylmethacrylate), poly(ethylmethacrylate), poly(methacrylamide), poly(methylacrylate), poly(ethylacrylate), poly(N-methylmethacrylamide) and/or poly(N,N-dimethylacrylamide); quaternary polymers with nitrogen or phosphorous as the quaternary or cationic atom with an aliphatic, cycloaliphatic or aromatic chain, where trivalent or tertiary sulfur may be substituted for the quaternary nitrogen or phosphorous in the polymers; and/or a polar and generally soluble polymer in polar solvents.

Figure 2:
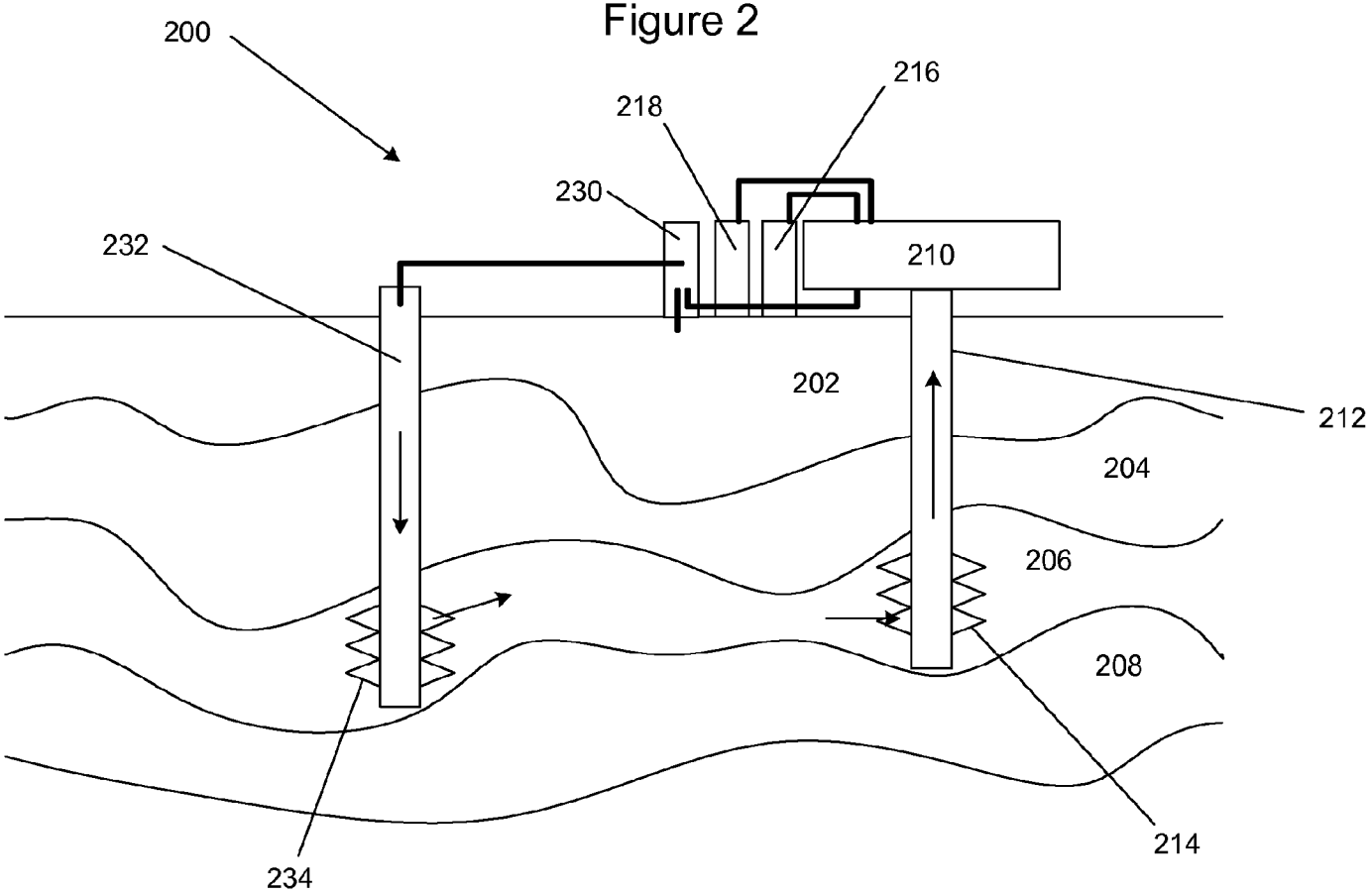
FIG. 2 illustrates an oil and gas production system.

Referring now to FIG. 2, in one embodiment of the invention, system 200 is illustrated. System 200 includes body of water 202, formation 204, formation 206, and formation 208. Production facility 210 may be provided at the surface of body of water 202. Well 212 traverses body of water 202 and formation 204, and has openings at formation 206. Portions of formation may be fractured and/or perforated as shown at 214. As oil and gas is produced from formation 206 it enters portions 214, and travels up well 212 to production facility 210. Gas and liquid may be separated, and gas may be sent to gas storage 216, and liquid may be sent to liquid storage 218, and water may be sent to water production 230. Production facility 210 is able to process water, for example from body of water 202 and/or well 212, which may be processed and stored in water production 230. Water from well 212 may be sent to water production 230. Processed water may be pumped down well 232, to fractured portions 234 of formation 206. Water traverses formation 206 to aid in the production of oil and gas, and then the water the oil and gas may be all produced to well 212, to production facility 210. Water may then be recycled, for example by returning water to water production 230, where it may be processed, then re-injected into well 232.

Hydrocarbons, such as oil and/or gas, may be recovered from the earth's subsurface formation 206 through production wellbore 212 that penetrate hydrocarbon-bearing formations or reservoirs. Perforations may be made from the production wellbore 206 to portions of the formation 214 to facilitate flow of the hydrocarbons from the hydrocarbon-bearing formations to the production wellbores. Water may be injected under pressure into injection zones 234 formed in the subsurface formation 206 to stimulate hydrocarbon production through the production wells in a field. Water may be injected by itself as a component of miscible or immiscible displacement fluids. Sea water (for offshore wells) and brine produced from the same or nearby formations (for onshore wells) may be used as the water source. Such water may contain amounts (concentration) of precursor ions, such as divalent sulfate ($SO_4^-$), which may form insoluble salts when they come in contact with cations, such as $Ba^{++}$, $Sr^{++}$ and $Ca^{++}$, resident in the formations. The resulting salts ($BaSO_4$, $SrSO_4$ and $CaSO_4$) can be relatively insoluble at subsurface formation temperature and pressure. Such salts may precipitate out of the solution. The precipitation of the insoluble salts may accumulate and consequently plug the subsurface fluid passageways. The plugging effects may be most severe in passageways in the formation near the injection well 232 and at the perforations of the production well 212. Solubility of the insoluble salts may further decrease as the injection water is produced to the surface through the production well 212, due to the reduction of the temperature and pressure as the fluids move to the surface through the production well. Subsurface or formation fluid passageways may include pores in the formation matrix, fractures, voids, cavities, vugs, perforations and fluid passages through the wells, including cased and uncased wells, tubings and other fluid paths in the wells. Precipitates may include insoluble salts, crystals or scale. Plugging may include reduction in the porosity and/or permeability of fluid passageways and the tubulars used in producing the well fluids and processing of those fluids. Injection water may include any fluid containing water that is injected into a subsurface formation to facilitate recovery of hydrocarbons from subsurface formations.

One purpose of injection well 232 is to aid the flow of hydrocarbons from the reservoir to production well 212. One method is to inject water under pressure adjacent to a production zone to cause the hydrocarbons trapped in the formation 206 to move toward the production well 212.

Figure 3:
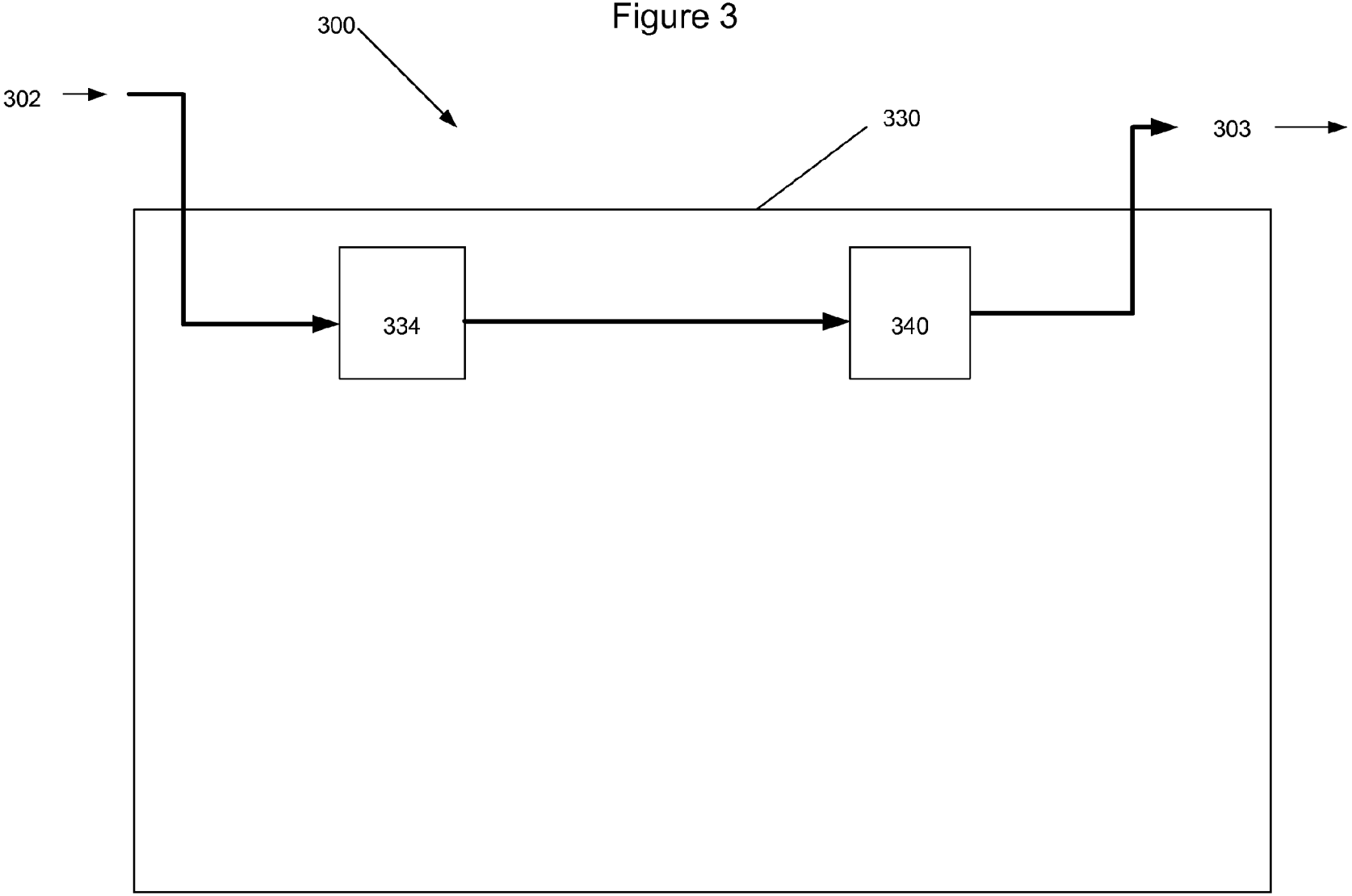
FIG. 3 illustrates a water processing system.

Referring now to FIG. 3, in some embodiments of the invention, a system 300 for water production 330 is illustrated. Water production 330 has an input of unprocessed water, for example water from a body of water, from a well, seawater, city water supply, or another water supply. At 334 some cations may be removed from raw water 302, for example monovalent cations, or multivalent cations, such as divalent or trivalent cations. At 340, an agent may be added to partially processed water in order to increase the viscosity of the water. Processed water 303 is then produced from water production 330.

Figure 4:
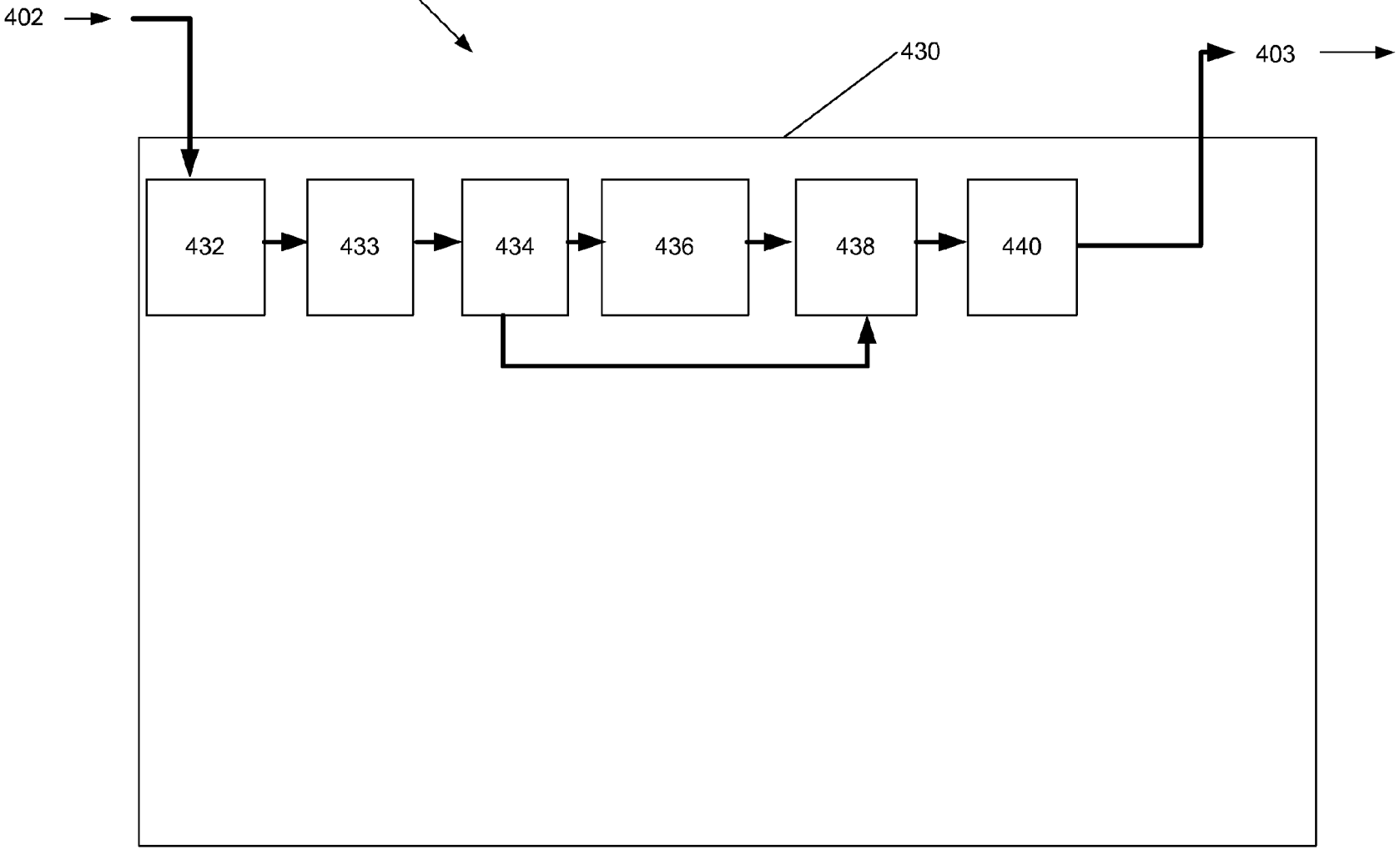
FIG. 4 illustrates a water processing system.

Referring now to FIG. 4, in some embodiments of the invention, system 400 for water production 430 is illustrated. Water production 430 has an input of unprocessed water 402, for example water from the body of water from a well, sea water, city water supply, or another water supply. At 432, primary filtration may be accomplished to remove solids from water. At 433 sulphates ($SO_4$) may be removed. At 434, some divalent cations may be removed, for example from about 60 to about 99% of the divalent cations present. Divalent cations which may be removed include magnesium (Mg), calcium (Ca), iron (Fe) and/or strontium (Sr).

In some embodiments, 433 and 434 may be performed at the same time with a nanofiltration membrane system.

At 436, some monovalent ions may be removed, for example from about 60 to about 99% of the cations present, such as sodium (Na), and/or potassium (K), along with the associated anions, for example chloride, fluoride, and/or bromide. At 438, some divalent cations may be added back to water, for instance adding back some magnesium, calcium, and/or strontium. At 440, an agent may be dissolved into water, where the agent increases the viscosity of the water. Processed water 403 may be produced by water production 430.

In some embodiments, water production 330 and/or 430 may use a membrane based system, for example reverse osmosis (RO) and/or nanofiltration (NF) technology, such as are used for seawater desalination, filtration, and/or purification.

The driving force for permeation for membrane separation may be the net pressure across the membrane; this is defined as the feed pressure minus the permeate or back pressure, less the difference between the osmotic pressure of the feed and the osmotic pressure of the permeate.

U.S. Pat. No. 4,723,603 employs NF membranes for specific removal of sulfate from seawater. Sulfates may be removed by NF membranes, and the NF permeate, may be rich in sodium chloride but deficient in sulfate. Such sulfate-free water may prevent the formation of barium sulfate, which has low solubility and can cause clogging. U.S. Pat. No. 4,723,603 is herein incorporated by reference in its entirety.

U.S. Pat. No. 4,341,629 discloses desalinating seawater by using two RO modules, which can include the same membrane, e.g. a 90% rejection cellulose triacetate (CTA) RO membrane, or two different membranes, e.g. an 80% rejection CTA membrane and a 98% rejection CTA membrane. U.S. Pat. No. 4,341,629 is herein incorporated by reference in its entirety.

U.S. Pat. No. 5,238,574 discloses the use of a multiplicity of RO membrane modules to process seawater. For example, a first low-pressure RO membrane may be followed by a high pressure RO membrane, or a series of low pressure RO membranes can be used, to either provide permeate of varying water quality or simply to produce a combined permeate where the concentrate stream from one module becomes the feedstream for the next module in series. U.S. Pat. No. 5,238,574 is herein incorporated by reference in its entirety.

In some embodiments, system 400 may include unprocessed water 402, from an aqueous feed source such as seawater from the ocean, or any saline water source having some divalent and monovalent ions, such as produced water from a well. As one example, raw seawater may be taken from the ocean, either from a sea well or from an open intake, and initially subjected to primary filtration 432 using a large particle strainer (not shown), and/or multi-media filters, which might be typically sand and/or anthracite coal, optionally followed by a cartridge filtration.

In some embodiments, processes 433, 434, and/or 436 can include one or a plurality of RO cartridges which may be located downstream of one or a plurality of NF cartridges. RO cartridges and/or NF cartridges may be spirally wound semipermeable membrane cartridges, or cartridges made using hollow fiber technology having suitable membrane characteristics. For example, E. I. DuPont sells RO cartridges of hollow fine fiber (HFF) type, which are marketed by DuPont as their HFF B-9 cartridges and which may be used. A spirally wound semipermeable membrane cartridge may include a plurality of leaves which are individual envelopes of sheet-like semipermeable membrane material that sandwich therebetween a layer of porous permeate carrying material, such as polyester fibrous sheet material. The semipermeable membrane material may be any of those commercially available materials. Interleaved between adjacent leaves may be lengths of spacer material, which may be woven or other open mesh, screen-like crosswise designs of synthetic filaments, e.g. cross-extruded filaments of polypropylene or the like such as those sold under the trade names Vexar and Nalle, that provide flow passageways for the feed water being pumped from end to end through a pressure vessel. A lay-up of such alternating leaves and spacer sheets may then be spirally wound about a hollow tube having a porous sidewall to create a right circular cylindrical cartridge.

One spirally wound separation cartridge is disclosed in U.S. Pat. No. 4,842,736, the disclosure of which is incorporated herein by reference, which provides a plurality of spiral feed passageways which extend axially from end to end of the ultimate cartridge, through which passageways the feed liquid being treated flows in an axial direction. Internally within the membrane envelopes, the permeating liquid flows along a spiral path inward in a carrier material until it reaches the porous central tube where it collects and through which it then flows axially to the outlet.

In some embodiments, RO cartridges and/or NF cartridges may be selected so as to accomplish the desired overall function of producing a stream of processed water having the desired ionic concentrations from seawater or the like. RO elements or cartridges may be selected from suitable semipermeable membranes of the polyamide composite membrane variety, wherein a thin film of polyamide may be interfacially formed on a porous polysulfone support or the like that may be in turn formed on a highly porous fibrous backing material. RO membranes may be designed to reject more than about 95% of dissolved salts, for example about 98% or more.

Suitable commercially available RO membranes include those sold as AG8040F and AG8040-400 by Osmonics; SW30 Series and LE by Dow-FilmTec; as DESAL-11 by Desalination Systems, Inc.; as ESPA by Hydranautics; as ULP by Fluid Systems, Inc.; and as ACM by TriSep Corporation.

NF membranes may be employed which are designed to selectively reject divalent or larger ions, and the NF elements or cartridges which are used may reject a minimum of about 80%, for example more than about 90%, or about 95%, or about 98% of the divalent or larger ions in an aqueous feed. The NF membrane may also at least moderately reduces the monovalent ion content, for example less than about 70%, or less than about 50%, or less than about 30%, or less than about 20% of the monovalent ion content.

Suitable commercially available NF membranes can be purchased either in sheet form or in finished spirally wound cartridges, and include those sold as SEASOFT 8040DK, 8040DL, and SESAL DS-5 by Osmonics; as NF200 Series and NF-55, NF-70 and as NF-90 by Dow-Film Tec; as DS-5 and DS-51 by Desalination Systems, Inc., as ESNA-400 by Hydranautics; and as TFCS by Fluid Systems, Inc.

In some embodiments, a mechanical method, such as passing the unprocessed water 402 through a nano-filtration membrane, may be used to remove ions from the water at the surface before injecting it into the wellbore and/or adding an agent 440. Sea water may contain from about 2700 to about 2800 ppm of divalent $SO_4^-$. The nano-filtration membrane process may reduce this concentration 433 to about 20 to about 150 ppm. A 99% reduction in sulfate content may be achievable.

In some embodiments, chemicals and/or additives may be injected into the untreated water 402 to inhibit the in-situ growth of crystals from insoluble salt precipitation. A variety of additives are injected into the injection water at the surface or directly into an injection well. Production wells may also often be treated with back-flow of fresh brine containing additives to prevent plugging of the passageways.

In some embodiments, salt water may be processed 433, 434, and/or 436 by multistage flash distillation, multieffect distillation, reverse osmosis and/or vapor compression distillation. Membrane technologies have been used in the pretreatment of salt water to reduce the high ionic content of salt water relative to fresh water. Ion selective membranes may be used which selectively prevent certain ions from passing across it while at the same time allowing the water and other ions to pass across it. The selectivity of a membrane may be a function of the particular properties of the membrane, including the pore size or electrical charge of the membrane. Accordingly, any of the known and commercially available ion selective membranes which meet these criteria can be used. For example, a polyamide membrane is particularly effective for selectively preventing sulfate, calcium, magnesium and bicarbonate ions from passing across it, and could be used for processes 433 and/or 434. A polyamide membrane having the trade name SR90-400 (Film Tec Corporation) or HYDRANAUTICS CTC-1 may be used.

In some embodiments of the invention, unprocessed water 402 containing a high concentration of hardness ions (for example divalent cations) is passed through an ion selective membrane 434 to form a softened salt water having a reduced concentration of hardness ions. The softened salt water is fed to a desalination system 436. Then, some of the hardness ions may be added back to the water at 438, and a viscosifier added at 440.

Microfiltration (MF), ultrafiltration (UF), nanofiltration (NF), and reverse osmosis (RO) are all pressure-driven separation processes allowing a broad range of neutral or ionic molecules to be removed from fluids. Microfiltration may be used for removal of suspended particles greater than about 0.1 microns. Ultrafiltration may be used to exclude dissolved molecules greater than about 5,000 molecular weight. Nanofiltration membranes may be used for passing at least some salts but having high rejection of organic compounds having molecular weights greater than approximately 200 Daltons. Reverse osmosis membranes may be used for high rejection of almost all species. While NF and RO are both capable of excluding salts, they typically differ in selectivity. NF membranes commonly pass monovalent ions while maintaining high rejection of divalent ions. By contrast, reverse osmosis membranes are relatively impermeable to almost all ions, including monovalent ions such as sodium and chloride ions. NF membranes have sometimes been described as "loose" RO membranes. One suitable membrane capable of removing dissolved salts from water is the cellulose acetate membrane, with selectivity resulting from a thin discriminating layer that is supported on a thicker, more porous layer of the same material. Another suitable membrane is made of piperazine or substituted piperazine. Other suitable membranes include polymers such as the commercial FilmTec NF40 NF membranes.

In some embodiments, a spiral-wound filter cartridge may be used to incorporate large amounts of RO or NF membrane into a small volume. Such an element can be made by wrapping feed spacer sheets, membrane sheets, and permeate spacer sheets around a perforated permeate tube.

In some embodiments, interfacial polymerization may be used to make thin film composite membranes for RO and NF separations. This process is commonly performed as a polycondensation between amines and either acid chlorides or isocyanates.

Reverse osmosis membranes may have high rejection of virtually all ions, including sodium and chloride. NF membranes are often characterized as those having a substantial passage of neutral molecules having molecular weights less than 200 daltons and monovalent ions. NF membranes still commonly possess high rejection of divalent ions due to charge interactions. Membranes having a continuum of properties between RO and NF can also be produced. In addition to high rejection of at least one species, commercial membranes often possess high water permeability.

In some embodiments, membranes for RO and/or NF may be piperazine-based membranes, where at least 60% of amine-containing monomers incorporated into the polymer may be piperazine or piperazine derivative molecules. One typical example of a piperazine-based membrane is the FilmTec NF40 NF membrane, which has been made by contacting piperazine and TMC in the presence of an acid acceptor, N,N-dimethylpiperazine. The FilmTec commercial membranes NF45 and SR90 have been made by similar processes, with additional proprietary chemicals added to the water and/or organic phase. A particularly useful property of some membranes is the ability to selectively remove some molecules while retaining others. For example, the dairy industry has used piperazine-based membranes to concentrate large neutral molecules (whey and lactose) while removing minerals. In other cases it is desired to pass monovalent salts while maintaining high rejection of divalent ions.

In some embodiments, processes 334, 433, and/or 434 may use a NF device, such as a membrane. In some embodiments, processes 334 and/or 436 may use a RO device, such as a membrane.

In some embodiments of the invention, agents for increasing the viscosity and/or increasing oil recovery may include one or more of:

1) alkyl xylene sulfonates, commercially available as ARISTONATE H-LF from Pilot;
2) alkyl benzene sulfonates, commercially available as BIOSOFT S90, BIOSOFT LAS-40S from Stepan;
3) CI8 alkyl toluene sulfonates;
4) alkyl aryl sulfonates, commercially available as ORS-41, ORS-60, ORS-62, ORS-64, ORS-66, ORS-72, ORS-97, ORS-162, ORS-164, ORS-166 from Oil Chem Technologies; PETRONATE EOR 2037, PETRONATE EOR 2094, and PETRONATE EOR 2095 from Crompton; and PETROSTEP B-100;
5) alkyl naphthalene sulfonates, commercially available as PETRO AA and PETRO P from Akzo Nobel;
6) polyethoxyalkylated alkyl sulfate, commercially available as STEOL CS330 from Stepan;
7) Sodium lauryl ethoxy sulfate, commercially available as STEOL CS-460;
8) Ethoxylated styrylaryloxy sulfonate;
9) Polyoxyethylene alkylether sulfonate;
10) Carboxymethylated ethoxylate, commercially available as NEODOX from DanChem Technologies;
11) Nonylphenol polyethyleneoxide ether sulfate, commercially available as TRITON XN-45S from Dow;
12) Petroleum Sulfonates, commercially available as ARISTONATE VH from Pilot; and as WITCO 2094;
13) Alkoxylated alkylphenol sulfonates, commercially available as TRITON X-200 from Dow;
14) Alpha-olefin sulfonate CI2-16, commercially available as STEPANTAN AS-1216, STEPANTAN AS-1246;
15) Alpha-olefin sulfonate CI4-16, commercially available as BIOTERGE AS-40;
16) Alpha-olefin sulfonate C16-18, commercially available as STEPANTAN AS-1618;
17) Internal olefin sulfonate C15-18, commercially available as IOS 1518;
18) Internal olefin sulfonate C17-20, commercially available as IOS 1720;
19) Sodium alkyl sulfate, commercially available as STEPANOL LCP;
20) Sodium methyl 2-sulfonyllaurate, commercially available as ALPHASTEP ML-40;
21) Sodium lignosulfonate, commercially available as D-1766 from Lignotech;
22) Alkyl propoxy sulfates
23) Hydrolyzed Polyacrylamide, commercially available as FLOPAAM 3630S, FLOPAAM 3530S, FLOPAAM 3430S, FLOPAAM 3330S, FLOPAAM 3230S from SNF; MAGNAFLOC 3336 from Ciba; ALCOFLOOD 1275A, ALCOFLOOD 1285REL, PRAESTOL 2640SL, and SPUREFLOC AF1266;
24) polyvinylpyrrolidones;
25) hydroxyethyl celluloses;
26) cellulose sulphate esters;
27) guar gums;
28) xanthans;
29) scleroglucans;
30) polyacrylic acid polymers;
31) alkyl acrylamide polymers;
32) polysaccharide polymers;

33) copolymers of acrylamides and acrylic acid or sodium acrylate;
34) N-sulfohydrocarbon-substituted acrylamides;
35) biopolysaccharides;
36) copolymers of acrylamide and sodium acrylate;
37) solutions of partially saponified polyacrylamide;
38) copolymers containing from about 99 to about 50 percent by weight acrylamide units and from about 1 to about 50 percent by weight acrylate units;
39) polyacrylamide containing up to about 10 mole percent carboxylate groups;
40) random copolymers of 90 mole percent or more acrylamide and ten mole percent or less acrylic acid or acrylic acid salts;
41) homopolymers of N-methyl-acrylamide or N,N-dimethylacrylamide;
42) copolymers or terpolymers of 0.1-99.9 mole percent acrylamide and 99.9-0.1 mole percent N-methylacrylamide and/or N,N-dimethylacrylamide;
43) poly(methylmethacrylate), poly(ethylmethacrylate), poly(methacrylamide), poly(methylacrylate), poly(ethylacrylate), poly(N-methylmethacrylamide) and/or poly(N,N-dimethylacrylamide);
44) quaternary polymers with nitrogen or phosphorous as the quaternary or cationic atom with an aliphatic, cycloaliphatic or aromatic chain, where trivalent or tertiary sulfur may be substituted for the quaternary nitrogen or phosphorous in the polymers;
45) a polar and generally soluble polymer in polar solvents;
46) surfactants;
47) soaps; and/or
48) alkalis, for example carbonates or hydroxides.

In some embodiments, the term "polyacrylamide" includes any cationic, anionic, nonionic or amphoteric polymer that may be comprised of acrylamide or methacrylamide recurring units. The polyacrylamides may be vinyl-addition polymers and may be prepared by methods such as by homopolymerization of acrylamide or by copolymerization of acrylamide with cationic, anionic, and/or nonionic comonomers. Suitable cationic comonomers include diallyldialkylammonium halides, the acid and quaternary salts of dialkylaminoalkyl(alk)acrylates and dialkylaminoalkyl(alk) acrylamides, for example the methyl chloride, benzyl chloride and dimethyl sulfate quaternary salts of dimethylaminoethylacrylate, dimethylaminoethylmethacrylate, dimethylaminoethylacrylamide, dimethylaminoethylmethacrylamide, and diethylaminoethylacrylate, for example diallyidimethylammonium chloride and the methyl chloride quaternary salt of dimethylaminoethylacrylate. Anionic comonomers may include acrylic acid, methacrylic acid, and 2-acrylamido-2-methylpropanesulfonic acid, and salts thereof, for example acrylic acid and sodium acrylate. Nonionic comonomers may include acrylonitrile and alkyl(meth) acrylates such as methylacrylate, methylmethacrylate, and ethyl acrylate. The polyacrylamides may also be formed by post-reaction of polyacrylamides in a manner well-known to those skilled in the art by reacting the polyacrylamide with a reagent capable of changing the chemical structure of the polymer. Post-reactions of polyacrylamide may include hydrolysis with acid or base to produce hydrolyzed polyacrylamide, Mannich reaction (optionally followed by quaternization to produce quaternized Mannich polyacrylamide), and reaction with hydroxylamine (or salt thereof) to produce hydroxamated polyacrylamide. Cationic and anionic polyacrylamides may be used.

In some embodiments of the invention, agents for increasing the viscosity include polymers comprising an N-vinyl lactam and an unsaturated amide, such as N-vinyl-2-pyrrolidone, including homopolymers, copolymers and terpolymers, as disclosed in U.S. Pat. No. 6,030,928, herein incorporated by reference in its entirety. In some embodiments of the invention, agents for increasing the viscosity include viscosifiers, such as polymeric thickening agents, that may be added to all or part of an injected water composition in order to increase the viscosity thereof.

In some embodiments, agents have a weight average molecular weight of from about $1\times10^6$ to about $40\times10^6$, for example from about $5\times10^6$ to about $30\times10^6$, or for example from about from about 4 to about 7 million or from about 15 to about 30 million. In some embodiments, the molecular weight is about 100,000 or greater, for example about 1,000,000 or greater, such as about 10,000,000 or greater. Molecular weights may be determined by light scattering, using commercially available instrumentation and techniques that are known in the art.

In some embodiments, agents are sold by a variety of companies including Dow Chemical Co. in Midland, Mich. One agent may be Alcoflood® 1235, a water soluble polymeric viscosifier available from Ciba Specialty Chemicals in Tarrytown, N.Y.

In some embodiments, the agent may be added at 440 to the waterflood at a concentration of about 0.001% to about 1% by weight of the total solution.

The reduction of the mobility of a fluid in a porous media such as an oil-bearing reservoir can be accomplished by increasing the viscosity of the fluid, decreasing the permeability of the porous media, or by a combination of both. The agent may both increase the viscosity of water and/or reduce the permeability of a reservoir as a solution flows through it. The extent to which a particular concentration of a given agent performs these two functions may be very roughly a function of the agent's average molecular weight. The lower the permeability of the reservoir, the lower may be the average molecular weight of the agent which can be injected without significant wellbore plugging. For a given formation, however, it is entirely possible to have two partially hydrolyzed polyacrylamide solutions of the same average molecular weight which will exhibit radically different efficiencies for mobility control purposes. Where the molecular weight distribution of a polymer is relatively narrow, as is the case with some polymers, substantially all of the polymer may be effective in infectivity and mobility control. If the molecular weight distribution is broad, as is the case with some polymers, the mobility may be adversely affected by the lower molecular weight molecules in the polymer mixture, while the higher molecular weight molecules of the polymer indicate the presence of gel-like species that may result in wellbore plugging.

In some embodiments of the invention, agents for increasing the viscosity of the flooding water achieve a solution viscosity of at least about 10 centipoises at room temperature, and/or reduce the permeability of rock to the flooding water by adsorbing on the rock in the formation.

In some embodiments, agents may be selected based on viscosity retention, porous media flow performance, high temperature, high salinity, and high pressure conditions. In some embodiments, a solution with an agent should be at least five times more viscous than sea water.

In some embodiments, agents can be at least partially dissolved in various fluids, including for example an aqueous fluid, or in a fluid containing at least one composition selected from bases, polymeric viscosifiers, surfactants and cosurfactants, and combinations of any two or more of said compositions. The agents can be crosslinked with various crosslinking agents. The agents may be water-soluble or water-dispersible. In some embodiments of the invention, a composition includes an agent for increasing the viscosity, an aqueous fluid, and one or more of: surfactants, cosurfactants, corrosion inhibitors, oxygen scavengers, bactericides, and any combination thereof.

In some embodiments of the invention, processed water 303 and/or 403 may be combined with one or more of the aromatics, for example, benzene, toluene, or xylene; turpentine; tetralin; chlorinated hydrocarbons, for example, carbon tetrachloride or methlyene chloride; or other hydrocarbons, for example $C_5$-$C_{10}$ hydrocarbons and/or alcohols; steam; or sulfur compounds, for example, hydrogen sulfide, and then injected into a formation for enhanced oil recovery. For example, a mixture of processed water with an agent for increasing the viscosity mixed with alcohol, may be injected into a formation.

In some embodiments, a mixture of an agent and water may be subjected to shear forces in dynamic liquid dispersing or pumping devices such as centrifugal pumps. The mixtures can also be pumped in a loop so that they pass through the centrifugal pump several times until the desired polymer properties are obtained. Dynamic dispersing and pumping devices may be hydrodynamic flow machines, for example single- or multiple-stage rotary centrifugal pumps such as radial centrifugal pumps. Turbulent flow conditions are flow conditions characterized by irregular variations in the velocity of the individual liquid particles. A mixture may be passed through static cutting units with available water in order to provide a uniform slurry of particulate gel solids having a desired solids content without substantially degrading the agent, for example, reducing its molecular weight. The gel slurry resulting from passage through the static units may be either (a) introduced into a holding tank with gentle stirring for about 1-4 hours until the gel disappears and the agent dissolves to give a homogeneous solution concentrate at room temperature or slightly below, e.g., 15-20 C, or (b) the gel slurry may be fed continuously into a series of multiple hold tanks with sufficient overall residence time to form the homogeneous solution concentrate by the last hold tank. The homogeneous solution concentrate can then be passed through standard static mixers with available water for final dilution.

In some embodiments, the agent may be a polymer that may be prepared in the presence of crosslinking or branching agents, such as methylenebisacrylamide, and/or in the presence of chain transfer agents, such as isopropanol and lactic acid. As the amount of crosslinking agent is increased, the resulting aqueous composition of dispersed polymer tends to contain larger amounts of water-swellable polymer. As the amount of crosslinking agent is decreased, the resulting aqueous composition of dispersed polymer tends to contain lesser amounts of water-swellable polymer. Chain transfer agents tend to reduce polymer molecular weight and to render soluble polymers which would otherwise be water-swellable because of the presence of crosslinking agents. The aqueous compositions of the instant invention may contain water-soluble dispersed polymer or water-swellable dispersed polymer, or mixtures thereof.

In some embodiments, the agent may be a polymer, such as polyacrylamide, that may be prepared by using techniques such as polymerization in solution, water-in-oil emulsion, water-in-oil microemulsion or aqueous dispersion, for example water-in-oil emulsion or water-in-oil microemulsion. Polyacrylamide particles may be formed by methods such as by grinding or comminution of a solution-polymerized mass of dry polyacrylamide. Spray-dried polyacrylamide particles may be used and may be formed by spray-drying a polyacrylamide-containing dispersion, water-in-oil emulsion, or water-in-oil microemulsion.

In some embodiments, the agent may be a polymer, which may be mixed with water by contacting of the polymer particles with the moving stream of water so that it results in an aqueous composition comprised of about 0.01% or greater of dispersed polymer, for example 0.05% or greater, for example 0.1% or greater, for example 0.2% or greater, by weight based on total weight of said aqueous composition. In some cases the aqueous composition may contain more than 5% of dispersed polymer by weight, based on total weight of aqueous composition, but in other cases contains about 5% or less of dispersed polymer, for example about 2% or less, for example about 1% or less, on the same basis.

In some embodiments of the invention, agents for increasing the viscosity of the water include a small but effective amount of polymer used to produce the desired viscosity or other properties in the injection fluid. Based upon the properties of the formation and the intended nature and duration of the process, the type and amount of the agent may be selected to achieve the desired effects over the appropriate time period. In some embodiments, the amount of agent used will be in the range of from about 500 ppm to about 10,000 ppm, for example about 1,000 ppm to about 3,000 ppm, based on the weight of the injection fluid. Generally, there will be selected an economical amount and type of polymer to produce the desired effect for the required time.

In some embodiments of the invention, a composition comprising at least one water-soluble polymer may be prepared by combining at least one water-soluble polymer together in any sequence. The amount of water soluble polymer may be about 200 to about 10,000 ppm, for example about 250-500 ppm based on the entire combination. When the composition further comprises aqueous fluid, the aqueous fluid utilized will comprise or contain water and may be about 88 to about 99.91 wt % of the final combination. The composition may also contain other solvents, alcohols, and/or salts.

In some embodiments, the polymer solutions may contain the polymers in concentrations up to about 5000 ppm. Here, the upper concentration limit may be only due to the increasing viscosity, and the lower limit may be based on the increasing costs for recovery using larger amounts of more dilute solutions. For this reason, it may be preferable to use solutions having a polymer content up to about 3000 ppm, for example a polymer content from about 2000 ppm to about 3000 ppm. These solutions are then diluted after treatment in accordance with the invention to concentrations required for use of from about 300 ppm to about 2000 ppm.

Water may be commonly injected into subterranean hydrocarbon-bearing formations by itself or as a component of miscible or immiscible displacement fluids to recover hydrocarbons therefrom. Unprocessed water 302 and/or 402 can be obtained from a number of sources including brine produced from the same formation, brine produced from remote formations, or sea water. All of these waters may have a high ionic content relative to fresh water. Some ions present in unprocessed water 302 and/or 402 can benefit hydrocarbon production, for example, certain combinations and concentrations of cations and anions, including $K^+$, $Na^+$, $Cl^-$, $Br^-$, and/or $OH^-$, can stabilize clay to varying degrees in a formation susceptible to clay damage from swelling or particle migration. Other ions (or the same ions that benefit hydrocarbon production) present in the unprocessed water 302 and/or 402 can produce harmful effects in situ, for example, divalent $SO_4^-$ anions in the injection water may be particularly problematic because $SO4^-$ may form salts with cations already present in the formation, such as $Ba^{++}$. The resulting salts can be relatively insoluble at the formation temperatures and pressures. Consequently they may precipitate out of solution in situ. Solubility of the salts further decreases as the injection water may be produced to the surface with the hydrocarbons because of pressure and temperature decreases in the production well. The precipitates of the insoluble salts may accumulate in subterranean fluid passageways as crystalline structures, which ultimately plug the passageways and reduce hydrocarbon production. The effects of plugging may be most severe in passageways located in the formation near wellbores and in production wells where it may be more difficult for the produced fluids to circumvent blocked passageways.

In some embodiments of the invention, processed water or a processed water mixture 303 and/or 403 may be injected into formation 206, produced from the formation 206, and then recovered from the oil and gas, for example, by a centrifuge or gravity separator, and then processing the water at water production 230, then the processed water or a processed water mixture 303 and/or 403 may be re-injected into the formation 206.

In some embodiments of the invention, processed water or a processed water mixture 303 and/or 403 may be injected into an oil-bearing formation 206, optionally preceded by and/or followed by a flush, such as with seawater, a surfactant solution, a hydrocarbon fluid, a brine solution, or fresh water.

In some embodiments of the invention, processed water or a processed water mixture 303 and/or 403 may be used to improve oil recovery. The processed water or a processed water mixture 303 and/or 403 may be utilized to drive or push the now oil bearing surfactant flood out of the reservoir, thereby "sweeping" crude oil out of the reservoir. The processed water or a processed water mixture 303 and/or 403 may have a viscosity that helps to prevent what is referred to in the industry as channeling or "fingering", thus improving sweep efficiency. Oil may be recovered at production well 212 spaced apart from injection well 232 as processed water or a processed water mixture 303 and/or 403 pushes the oil out of the pores in formation 206 and to the production well 212. Once the oil/drive fluid reaches the surface, it may be put into holding tanks 218, allowing the oil to separate from the water through the natural forces of gravity.

The amount of oil recovered may be measured as a function of the original oil in place (OOIC). The amount of oil recovered may be greater than about 5% by weight of the original oil in place, for example 10% or greater by weight of the original oil in place, or 15% or greater by weight of the original oil in place.

The process and system may be useful for the displacement recovery of petroleum from oil-bearing formations. Such recovery encompasses methods in which the oil may be removed from an oil-bearing formation through the action of a displacement fluid or a gas. Thus, the recovery may be secondary, where the reservoir hydrocarbons have been substantially depleted by primary recovery mechanisms, or it may be tertiary, where the polymer solution may be injected after injection of conventionally used displacement fluids. Other uses for the processed water or a processed water mixture 303 and/or 403 prepared by the process and system of the invention include near wellbore injection treatments, and injection along interiors of pipelines to promote pipelining of high viscosity crude oil. The processed water or a processed water mixture 303 and/or 403 can also be used as hydraulic fracture fluid additives, fluid diversion chemicals, and loss circulation additives, to mention a few.

Those of skill in the art will appreciate that many modifications and variations are possible in terms of the disclosed embodiments, configurations, materials and methods without departing from their spirit and scope. Accordingly, the scope of the claims appended hereafter and their functional equivalents should not be limited by particular embodiments described and illustrated herein, as these are merely exemplary in nature.

That which is claimed is:

1. A system comprising:

a well drilled into an underground formation comprising hydrocarbons;

a production facility at a topside of the well;

a water production facility connected to the production facility;

wherein the water production facility produces water by removing some multivalent cations from a water by passing the water through a first membrane system, by removing some monovalent cations from the water by passing the water through a second membrane system, by adding back some multivalent cations to the water from which some of the monovalent cations have been removed, and adding an agent having a weight average molecular weight of at least 100,000 which increases the viscosity of the water or increases a hydrocarbon recovery from the formation, and injects the water into the well.

2. The system of claim 1, wherein the underground formation is beneath a body of water.

3. The system of claim 1, wherein the production facility is floating on a body of water.

4. The system of claim 1, further comprising a water supply and a water pumping apparatus adapted to pump water to the water production facility.

5. The system of claim 1, wherein the water production facility has an input water having a total dissolved salts value of at least 15,000 parts per million, expressed as sodium chloride dissolved.

6. The system of claim 1, wherein the agent comprises one or more materials selected from the group consisting of:

alkyl xylene sulfonates; alkyl benzene sulfonates; CI8 alkyl toluene sulfonates; alkyl aryl sulfonates; alkyl naphthalene sulfonates; polyethoxyalkylated alkyl sulfate; Sodium lauryl ethoxy sulfate; Ethoxylated styrylaryloxy sulfonate; Polyoxyethylene alkylether sulfonate; Carboxymethylated ethoxylate; Nonylphenol polyethyleneoxide ether sulfate; Petroleum Sulfonates; Alkoxylated alkylphenol sulfonates; Alpha-olefin sulfonate C12-16; Alphaolefin sulfonate C14-16; Alpha-olefin sulfonate C16-18; Internal olefin sulfonate C15-18; Internal olefin sulfonate C17-20; Sodium alkyl sulfate; Sodium methyl 2-sulfonyllaurate; Sodium lignosulfonate; Alkyl propoxy sulfates; Hydrolyzed Polyacrylamide; polyvinylpyrrolidones; hydroxyethyl celluloses; cellulose sulphate esters; guar gums; xanthans; scleroglucans; polyacrylic acid polymers; alkyl acrylamide polymers; polysaccharide polymers; copolymers of acrylamides and acrylic acid or sodium acrylate; N-sulfohydrocarbon-substituted acrylamides; biopolysaccharides; copolymers of acrylamide and sodium acrylate; solutions of partially saponified polyacrylamide; copolymers containing from 99 to 50 percent by weight acrylamide units and from 1 to 50 percent by weight acrylate units; polyacrylamide containing up to 10 mole percent carboxylate groups; random copolymers of 90 mole percent or more acrylamide and ten mole percent or less acrylic acid or acrylic acid salts; homopolymers of N-methylacrylamide or N,N-dimethylacrylamide; copolymers or terpolymers of 0.1-99.9 mole percent acrylamide and 99.9-0.1 mole percent N-methylacrylamide or N,Ndimethylacrylamide; poly (methylmethacrylate), poly(ethylmethacrylate), poly (methacrylamide), poly(methylacrylate), poly(ethylacrylate), poly(Nmethylmethacrylamide) or poly(N,N-dimethylacrylamide); quaternary polymers with nitrogen or phosphorous as the quaternary or cationic atom with an aliphatic, cycloaliphatic or aromatic chain, where trivalent or tertiary sulfur may be substituted for the quaternary nitrogen or phosphorous in the polymers; and a polar polymer soluble in polar solvents.

7. The system of claim 1, wherein the well has been fractured with a viscous liquid and a propping agent.

8. The system of claim 1, wherein the well comprises a diameter from 10 to 25 cm.

9. A system comprising:

a first well drilled into an underground formation comprising hydrocarbons;

a production facility at a topside of a first well;

a water production facility connected to the production facility;

a second well drilled into the underground formation;

wherein the water production facility produces water by removing multivalent cations from a water by passing the water through a first membrane system, by removing some monovalent cations from the water by passing the water through a second membrane system, by adding back some cations to the water from which some of the monovalent cations have been removed, and adding an agent having a weight average molecular weight of at least 100,000 which increases the viscosity of the water or increases a hydrocarbon recovery from the formation, and injects the water into the second well and into the underground formation.

10. The system of claim 9, wherein the first well is a distance of 50 meters to 2000 meters from the second well.

11. A method comprising:

removing some multivalent cations from an input water by passing the water through a first membrane system, removing some monovalent cations from the water by passing the water through a second membrane system, and adding back some multivalent cations to the water from which some of the monovalent cations have been removed to produce a partially processed water;

adding an agent having a weight average molecular weight of at least 100,000 to the partially processed water to produce a processed water, where addition of the agent to the partially processed water increases the viscosity of the processed water relative to the partially processed water or increases hydrocarbon recovery capacity of the processed water relative to the partially processed water of hydrocarbons from an underground formation comprising hydrocarbons; and injecting the water with the agent into the underground formation.

12. The method of claim 11, wherein the processed water is recycled by being produced with oil or gas and separated, and then re-injected into the formation.

13. The method of claim 11, wherein one or more of aromatics, chlorinated hydrocarbons, alcohols, $C_5$-$C_{10}$ hydrocarbons, water, carbon dioxide, carbon monoxide, or mixtures thereof are mixed with the processed water prior to being injected into the formation.

14. The methods of claim 11, wherein the processed water is heated prior to being injected into the formation.

15. The method of claim 11, wherein the processed water is heated while within the formation.

16. The method of claim 15, wherein the processed water is heated with hot water, steam or a non-aqueous liquid or gas injected into the formation.

17. The method of claim 11, wherein removing some multivalent cations from the water comprises removing some magnesium, calcium, iron, strontium, or barium cations.

18. The method of claim 11, wherein removing some monovalent cations from the water comprises removing some divalent cations and then removing some sodium or potassium cations.

19. The method of claim 11, wherein another material is injected into the formation after the processed water was injected.

20. The method of claim 19, wherein the another material is selected from the group consisting of air, produced water, salt water, sea water, fresh water, steam, carbon dioxide, and mixtures thereof.

21. The method of claim 11, wherein the processed water is injected from 10 to 100 bars above the reservoir pressure.

22. The method of claim 11, wherein the oil in the underground formation prior to water being injected has a viscosity from 5 cp to 10,000 cp.

23. The method of claim 11, wherein the oil in the underground formation prior to water being injected has a viscosity from 500 cp to 5,000 cp.

24. The method of claim 11, wherein the underground formation has a permeability from 5 to 0.0001 Darcy.

25. The method of claim 11, wherein the underground formation has a permeability from 1 to 0.001 Darcy.

26. The method of claim 11, wherein producing or injecting are done into or from a vertical or a horizontal well.

27. The method of claim 11, wherein the input water has a total dissolved salts value of at least 15,000 parts per million, expressed as sodium chloride dissolved, prior to removing some cations from the water.

28. The method of claim 11, wherein the agent comprises one or more materials selected from the group consisting of:

alkyl xylene sulfonates; alkyl benzene sulfonates; CI8 alkyl toluene sulfonates; alkyl aryl sulfonates; alkyl naphthalene sulfonates; polyethoxyalkylated alkyl sulfate; Sodium lauryl ethoxy sulfate; Ethoxylated styrylaryloxy sulfonate; Polyoxyethylene alkylether sulfonate; Carboxymethylated ethoxylate; Nonylphenol polyethyleneoxide ether sulfate; Petroleum Sulfonates; Alkoxylated alkylphenol sulfonates; Alpha-olefin sulfonate C12-16; Alphaolefin sulfonate C14-16; Alpha-olefin sulfonate C16-18; Internal olefin sulfonate C15-18; Internal olefin sulfonate C17-20; Sodium alkyl sulfate; Sodium methyl 2-sulfonyllaurate; Sodium lignosulfonate; Alkyl propoxy sulfates; Hydrolyzed Polyacrylamide; polyvinylpyrrolidones; hydroxyethyl celluloses; cellulose sulphate esters; guar gums; xanthans; scleroglucans; polyacrylic acid polymers; alkyl acrylamide polymers; polysaccharide polymers; copolymers of acrylamides and acrylic acid or sodium acrylate; N-sulfohydrocarbon-substituted acrylamides; biopolysaccharides; copolymers of acrylamide and sodium acrylate; solutions of partially saponified polyacrylamide; copolymers containing from 99 to 50 percent by weight acrylamide units and from 1 to 50 percent by weight acrylate units; polyacrylamide containing up to 10 mole percent carboxylate groups; random copolymers of 90 mole percent or more acrylamide and ten mole percent or less acrylic acid or acrylic acid salts; homopolymers of N-methylacrylamide or N,N-dimethylacrylamide; copolymers or terpolymers of 0.1-99.9 mole percent acrylamide and 99.9-0.1 mole percent N-methylacrylamide or N,Ndimethylacrylamide; poly (methylmethacrylate), poly(ethylmethacrylate), poly (methacrylamide), poly(methylacrylate), poly(ethylacrylate), poly(Nmethylmethacrylamide) or poly(N,N-dimethylacrylamide); quaternary polymers with nitrogen or phosphorous as the quaternary or cationic atom with an aliphatic, cycloaliphatic or aromatic chain, where trivalent or tertiary sulfur may be substituted for the quaternary nitrogen or phosphorous in the polymers; and a polar polymer soluble in polar solvents.

29. A system comprising:

a well drilled into an underground formation comprising hydrocarbons;

a production facility at a topside of the well;

an agent selected from the group consisting of alkyl xylene sulfonates; alkyl benzene sulfonates; C18 alkyl toluene sulfonates; alkyl aryl sulfonates; alkyl naphthalene sulfonates; polyethoxyalkylated alkyl sulfate; Sodium lauryl ethoxy sulfate; ethoxylated styrylaryloxy sulfonate; polyoxyethylene alkylether sulfonate; carboxymethylated ethoxylate; nonylphenol polyethyleneoxide ether sulfate; petroleum sulfonates; alkoxylated alkylphenol sulfonates; alpha-olefin sulfonate C12-16; alphaolefin sulfonate C14-16; alpha-olefin sulfonate C16-18; internal olefin sulfonate C15-18; internal olefin sulfonate C17-20; sodium alkyl sulfate; sodium methyl 2-sulfonyllaurate; sodium lignosulfonate; alkyl propoxy sulfates; hydrolyzed polyacrylamide; polyvinylpyrrolidones; alkyl acrylamide polymers; copolymers of acrylamides and acrylic acid or sodium acrylate; N-sulfohydrocarbon-substituted acrylamides; biopolysaccharides; copolymers of acrylamide and sodium acrylate; solutions of partially saponified polyacrylamide; copolymers containing from 99 to 50 percent by weight acrylamide units and from 1 to 50 percent by weight acrylate units; polyacrylamide containing up to 10 mole percent carboxylate groups; random copolymers of 90 mole percent or more acrylamide and ten mole percent or less acrylic acid salts; homopolymers of N-methylacrylamide or N,N-dimethylacrylamide; copolymers or terpolymers of 0.1-99.9 mole percent acrylamide and 99.9-0.1 mole percent N-methylacrylamide or N,Ndimethylacrylamide; poly(methylmethacrylate), poly(ethylmethacrylate), poly(methacrylamide), poly(methylacrylate), poly(ethylacrylate), poly (Nmethylmethacrylamide); poly(N,N-dimethylacrylamide); and quaternary polymers with nitrogen or phosphorous as the quaternary or cationic atom with an aliphatic, cycloaliphatic or aromatic chain, where trivalent or tertiary sulfur may be substituted for the quaternary nitrogen or phosphorous in the polymer; and a water production facility connected to the production facility; wherein the water production facility produces a processed water by removing some multivalent cations from an unprocessed water by passing the water through a first membrane system, by removing some monovalent cations from the water by passing the water through a second membrane system, by adding back some cations to the water from which some of the monovalent cations have been removed, and adding the agent to the unprocessed water, and injects the processed water into the well.

30. A method comprising:

removing from a source water some multivalent cations from the water by passing the water through a first membrane system, removing some monovalent cations from the water by passing the water through a second membrane system, and adding back some multivalent cations to the water from which some of the monovalent cations have been removed to produce a partially processed water;

adding an agent to the partially processed water to produce a processed water; and injecting the processed water with the agent into the underground formation, wherein the agent is selected from the group consisting of alkyl xylene sulfonates; alkyl benzene sulfonates; C18 alkyl toluene sulfonates; alkyl aryl sulfonates; alkyl naphthalene sulfonates; polyethoxyalkylated alkyl sulfate; Sodium lauryl ethoxy sulfate; ethoxylated styrylaryloxy sulfonate; polyoxyethylene alkylether sulfonate; carboxymethylated ethoxylate; nonylphenol polyethyleneoxide ether sulfate; petroleum sulfonates; alkoxylated alkylphenol sulfonates; alpha-olefin sulfonate C12-16; alphaolefin sulfonate C14-16; alpha-olefin sulfonate C16-18; internal olefin sulfonate C15-18; internal olefin sulfonate C17-20; sodium alkyl sulfate; sodium methyl 2-sulfonyllaurate; sodium lignosulfonate; alkyl propoxy sulfates; hydrolyzed polyacrylamide; polyvinylpyrrolidones; alkyl acrylamide polymers; copolymers of acrylamides and acrylic acid or sodium acrylate; N-sulfohydrocarbon-substituted acrylamides; biopolysaccharides; copolymers of acrylamide and sodium acrylate; solutions of partially saponified polyacrylamide; copolymers containing from 99 to 50 percent by weight acrylamide units and from 1 to 50 percent by weight acrylate units; polyacrylamide containing up to 10 mole percent carboxylate groups; random copolymers of 90 mole percent or more acrylamide and ten mole percent or less acrylic acid salts; homopolymers of N-methylacrylamide or N,N-dimethylacrylamide; copolymers or terpolymers of 0.1-99.9 mole percent acrylamide and 99.9-0.1 mole percent N-methylacrylamide or N,Ndimethylacrylamide; poly (methylmethacrylate), poly(ethylmethacrylate), poly (methacrylamide), poly(methylacrylate), poly(ethylacrylate), poly(N-methylmethacrylamide); poly(N,N-dimethylacrylamide); and quaternary polymers with nitrogen or phosphorous as the quaternary or cationic atom with an aliphatic, cycloaliphatic or aromatic chain, where trivalent or tertiary sulfur may be substituted for the quaternary nitrogen or phosphorous in the polymer.

* * * * *